US011369980B2

(12) United States Patent
Zhang et al.

(10) Patent No.: US 11,369,980 B2
(45) **Date of Patent: *Jun. 28, 2022**

(54) WATER SPRAY APPLIED LOOSE-FILL INSULATION

(71) Applicant: JOHNS MANVILLE, Denver, CO (US)

(72) Inventors: Mingfu Zhang, Highlands Ranch, CO (US); Thomas John Fellinger, Littleton, CO (US); Daniel Elden Near, Littleton, CO (US)

(73) Assignee: Johns Manville, Denver, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/158,199

(22) Filed: Jan. 26, 2021

(65) Prior Publication Data

US 2021/0146387 A1 May 20, 2021

Related U.S. Application Data

(60) Division of application No. 16/384,585, filed on Apr. 15, 2019, now Pat. No. 10,953,418, which is a continuation of application No. 14/248,069, filed on Apr. 8, 2014, now Pat. No. 10,259,001.

(51) Int. Cl.

| | |
|---|---|
| ***B05B 7/00*** | (2006.01) |
| ***E04F 21/08*** | (2006.01) |
| ***B05B 7/14*** | (2006.01) |

(52) U.S. Cl.

CPC ..... *B05B 7/00* (2013.01); *B05B 7/149* (2013.01); *E04F 21/085* (2013.01)

(58) Field of Classification Search

None

See application file for complete search history.

(56) References Cited

U.S. PATENT DOCUMENTS

| | | | | |
|---|---|---|---|---|
| 5,641,368 | A * | 6/1997 | Romes | B05B 7/1409 156/293 |
| 5,921,055 | A * | 7/1999 | Romes | B05B 7/1409 52/742.13 |
| 6,012,263 | A * | 1/2000 | Church | B05B 7/1409 156/71 |
| 6,047,518 | A * | 4/2000 | Lytle | E04B 1/7604 156/78 |
| 7,520,935 | B2 * | 4/2009 | Fellinger | E04F 21/085 118/308 |

(Continued)

*Primary Examiner* — Joshua K Ihezie

(74) *Attorney, Agent, or Firm* — Robert D. Touslee

(57) ABSTRACT

According to an embodiment, a method of applying loose-fill insulation within a cavity is provided. The method includes blowing loose-fill insulation particles into a cavity of a structure to install the loose-fill insulation within the cavity and thereby insulate the structure. The method also includes applying water (e.g., water mist) to the loose-fill insulation particles so that a moisture content of the installed loose-fill insulation is between about 2% and 20%. The water aids in retaining the loose-fill insulation particles within the cavity without requiring the use of an enclosure member that encloses the cavity and the loose-fill insulation is substantially free of a water soluble adhesive material that adheres the loose-fill insulation particles together within the cavity.

20 Claims, 7 Drawing Sheets

(56) References Cited

U.S. PATENT DOCUMENTS

| | | | | |
|---|---|---|---|---|
| 7,594,618 | B2 * | 9/2009 | Fellinger | E04B 1/7604 241/189.1 |
| 7,789,596 | B2 * | 9/2010 | Fellinger | E04F 21/085 406/46 |
| 10,259,001 | B2 * | 4/2019 | Zhang | B05B 7/149 |
| 2005/0014896 | A1 * | 1/2005 | Schmidt | E04F 21/085 525/54.3 |
| 2005/0055973 | A1 * | 3/2005 | Hagen | E04B 1/7604 52/741.1 |
| 2011/0224317 | A1 * | 9/2011 | O'Leary | C08J 9/08 521/70 |

* cited by examiner

| Pump | Water Flow (lbs/min) | Cavity | Blowing Nozzle Type | Installed Density Wet, pcf | Moisture Content | Installed Density Dry, pcf | Installed Density (dry, pcf) Ave. | Installed Density (dry, pcf) STDev |
|---|---|---|---|---|---|---|---|---|
| Wanner Hydra-Cel (Model: D03X) | 1.00 | 93" x 14.5" x 3.5" | HDN | 1.48 | 4.26% | 1.41 | 1.41 | |
| | 1.41 | 93" x 14.5" x 3.5" | HDN | 1.64 | 4.84% | 1.56 | 1.52 | 0.05 |
| | | 93" x 14.5" x 3.5" | HDN | 1.64 | 5.40% | 1.55 | | |
| | | 93" x 14.5" x 3.5" | HDN | 1.54 | 5.17% | 1.46 | | |
| | 1.69 | 93" x 14.5" x 3.5" | HDN | 1.46 | 6.23% | 1.36 | 1.42 | 0.09 |
| | | 93" x 14.5" x 3.5" | HDN | 1.46 | 6.09% | 1.37 | | |
| | | 93" x 14.5" x 3.5" | HDN | 1.62 | 5.55% | 1.53 | | |
| | 1.97 | 93" x 14.5" x 3.5" | HDN | 1.73 | 5.75% | 1.63 | 1.60 | 0.08 |
| | | 93" x 14.5" x 3.5" | HDN | 1.77 | 6.57% | 1.66 | | |
| | | 93" x 14.5" x 3.5" | HDN | 1.64 | 8.02% | 1.50 | | |
| | 2.19 | 93" x 14.5" x 3.5" | HDN | 1.67 | 6.85% | 1.56 | 1.54 | 0.05 |
| | | 93" x 14.5" x 3.5" | HDN | 1.70 | 7.74% | 1.57 | | |
| | | 93" x 14.5" x 3.5" | HDN | 1.62 | 8.12% | 1.49 | | |
| | | | | | | | | |
| Graco Magnum XS | 2.34 | 93" x 14.5" x 3.5" | HDN | 1.79 | 7.11% | 1.66 | 1.66 | |
| | 3.01 | 93" x 14.5" x 3.5" | HDN | 1.89 | 9.64% | 1.71 | 1.72 | 0.01 |
| | 3.01 | 93" x 14.5" x 3.5" | HDN | 1.90 | 9.51% | 1.72 | | |
| | 3.01 | 93" x 14.5" x 3.5" | LDN | 1.11 | 9.39% | 1.01 | 1.01 | |

Application of Loose-Fill Insulation within a 2x4 Wall Cavity

FIG. 6

| Pump | Water Flow (lbs/min) | Cavity | Blowing Nozzle Type | Installed Density Wet, pcf | Moisture Content | Installed Density Dry, pcf | Installed Density (dry, pcf) Ave. | Installed Density (dry, pcf) STDev |
|---|---|---|---|---|---|---|---|---|
| Graco Magnum X5 | 3.01 | 92.5" x 22.5" x 5.375" | HDN | 1.87 | 11.39% | 1.65 | 1.60 | 0.04 |
| | 3.01 | 92.5" x 22.5" x 5.375" | HDN | 1.75 | 10.74% | 1.56 | | |
| | 3.01 | 92.5" x 22.5" x 5.375" | HDN | 1.80 | 10.11% | 1.62 | | |
| | 3.01 | 92.5" x 22.5" x 5.375" | HDN | 1.76 | 9.81% | 1.59 | | |
| | 3.01 | 92.5" x 22.5" x 5.375" | LDN | 1.17 | 9.98% | 1.06 | 1.06 | |

Application of Loose-Fill Insulation within a 2x6 Wall Cavity

FIG. 7

| Pump | Water Flow (lbs/min) | Cavity | Blowing Nozzle Type | Installed Density Dry, pcf |
|---|---|---|---|---|
| Graco Magnum X5 | 3.01 | 95.75" x 23.25" x 18" | HDN | 2.26 |

Application of Loose-Fill Insulation within an Overhead Cavity

FIG. 8

| Sample Frame No. | Pump | Water Flow | Cavity | Blowing Nozzle Type | Installed Density | Moisture Content | Installed Density |
|---|---|---|---|---|---|---|---|
| | | (lbs/min) | | | Wet, pcf | | Dry, pcf |
| Sample 1 | Graco Magnum X5 | 3.00 | 21.5" x 21.5" x 5.5" | HDN | 2.40 | 10.08% | 2.16 |
| Sample 2 | | 3.00 | 21.5" x 21.5" x 5.5" | HDN | 1.93 | 9.54% | 1.75 |
| Sample 3 | | 3.00 | 21.5" x 21.5" x 5.5" | HDN | 1.45 | 9.17% | 1.31 |

WATER SPRAY APPLIED LOOSE-FILL INSULATION

CROSS REFERENCE TO RELATED APPLICATION

This application is a division of U.S. application Ser. No. 16/384,585 filed Apr. 15, 2019, which is a continuation of U.S. application Ser. No. 14/248,069, filed Apr. 8, 2014, now U.S. Pat. No. 10,259,001 issued Apr. 16, 2019.

BACKGROUND OF THE INVENTION

Spray applied loose-fill fiberglass insulation has been gaining increasing interest in the marketplace, due to its inherent fire resistance, mold resistance, high thermal performance, minimal potential for settling, and other advantages. Conventional fiberglass loose-fill insulation is typically spray applied with water soluble adhesives, such as polyvinyl acetate and vinyl acetate/ethylene copolymer. Generally, these adhesives have high viscosity, and their viscosity is highly dependent on temperature—i.e., their viscosity can increase exponentially with reducing temperature. Therefore, expensive pumping systems with heating capability are needed to handle the viscous liquid adhesives.

In other instances, powder adhesives have been used by pre-blending adhesives with fiberglass insulation. In such instances, a significant amount of water needs to be applied to the fiberglass insulation to activate the powder adhesives, resulting in a high moisture content of the installed loose-fill insulation. High moisture content leads to longer drying time and increased potential of mold growth on for example wood studs.

BRIEF SUMMARY OF THE INVENTION

The present invention generally provides improved systems, devices, and methods for installing loose-fill insulation within a cavity. According to an embodiment, a method of applying loose-fill insulation within a cavity is provided. The method includes providing a loose-fill insulation blowing apparatus having a hopper configured to house the loose-fill insulation material and a shredder configured to break compressed loose-fill insulation material into a plurality of insulation particles. The blowing apparatus also includes a blower/air lock assembly configured to blow the loose-fill insulation particles into the cavity, a hose member connected to the blower/air lock assembly, and a nozzle attached to a distal end of the hose through which the loose-fill insulation particles are blown during application of the loose-fill insulation material within the cavity. The method also includes blowing the loose-fill insulation particles through the nozzle and into the cavity via the blower/air lock assembly and applying a water mist to the loose-fill insulation particles as the insulation particles are blown through the nozzle and into the cavity. The water mist is applied so that a moisture content of the installed loose-fill insulation is between about 2% and 20%. The applied water mist aids in retaining the loose-fill insulation particles within the cavity without requiring the use of an enclosure member that encloses the cavity. The loose-fill insulation material is substantially free of an adhesive material that adheres the loose-fill insulation particles together within the cavity.

According to another embodiment, a method of applying loose-fill insulation within a cavity is provided. The method includes blowing loose-fill insulation particles into a cavity of a structure to install the loose-fill insulation within the cavity and thereby insulate the structure. The loose-fill insulation particles are blown, via a blower mechanism, through a hose and a nozzle attached to a distal end of the hose to install the loose-fill insulation within the cavity. The method also includes applying water to the loose-fill insulation particles so that a moisture content of the installed loose-fill insulation is between about 2% and 20%. The water aids in retaining the loose-fill insulation particles within the cavity without requiring the use of an enclosure member that encloses the cavity and the loose-fill insulation is substantially free of a water soluble or powder adhesive material that adheres the loose-fill insulation particles together within the cavity.

According to another embodiment, a system for applying loose-fill insulation within a cavity is provided. The system includes a hopper that is configured to receive an insulation material and a loose-fill forming component that is attached to the hopper and that is configured to break the insulation material into a plurality of loose-fill insulation particles. The system also includes a blower/air lock assembly configured to blow the loose-fill insulation particles into the cavity, a hose member connected at a proximal end to the blower/air lock assembly, and a nozzle attached to a distal end of the hose and through which the loose-fill insulation particles are blown during installation of the loose-fill insulation particles within the cavity. The system further includes a water mist application component that is coupled to the nozzle near the distal end thereof. The water mist application component is configured to apply water mist to the loose-fill insulation particles as the insulation particles are blown through the nozzle and into the cavity so that a moisture content of the installed loose-fill insulation particles is between about 2% and 20%. Alternatively, the water mist can be applied to the loose-fill insulation within the hopper of the blowing machine, at the blower, and/or within the blowing hose. The water mist aids in retaining the loose-fill insulation particles within the cavity without requiring the use of an enclosure member that encloses the cavity. The loose-fill insulation particles are substantially free of an adhesive material that adheres the insulation particles together within the cavity.

BRIEF DESCRIPTION OF THE DRAWINGS

The present invention is described in conjunction with the appended figures:

FIGS. 6-8 illustrate various tables of data resulting from tests conducted to determine the effectiveness of installing loose-fill fiberglass insulation within cavities in accordance with the embodiments described herein.

Figure 1:
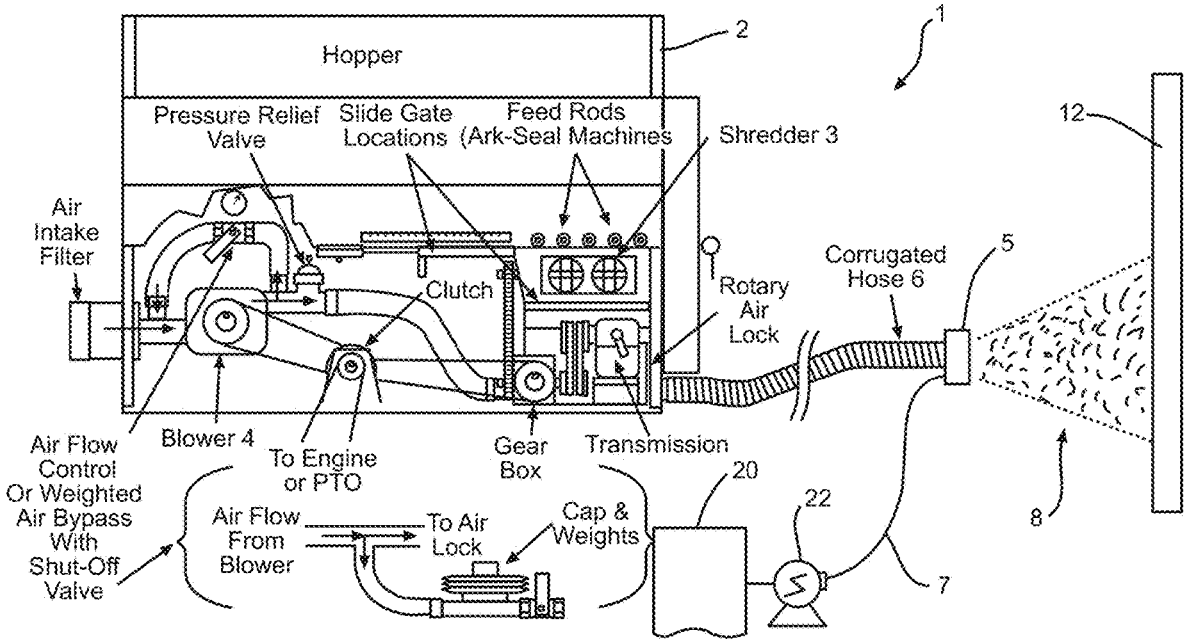
FIG. 1 illustrates system for installing loose-fill insulation within a cavity according to an embodiment.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

For ease in describing the embodiments herein, the loose-fill insulation will be generally described as being fiberglass insulation, although the insulation particles can be formed from many materials that are capable of being suspended in air. For example, in some instances, other types of loose-fill insulation including, but not limited to, insulation particles formed from an inorganic fibrous material such as, slag wool, mineral wool, rock wool, ceramic fibers, carbon fibers, composite fibers, and mixtures thereof. In an exemplary embodiment, the loose-fill insulation material includes mainly or entirely fiberglass.

The description and/or claims herein may also use relative terms in describing features or aspects of the embodiments. For example, the description and/or claims may use terms such as relatively, about, substantially, approximately, and the like. These relative terms are meant to account for deviations that may be appreciated or accepted in the insulation industry. For example, the description and/or claims may describe the loose-fill insulation being applied relatively uniformly. The term "relatively" may account for deviations from uniform that may be appreciated and/or accepted during installation of the loose-fill insulation. These deviations may be up to about 10%, but are typically less than 5% and often less than about 3%. A similar rationale applies to any of the other relative terms used herein.

The embodiments described herein provide methods, devices, and systems that are used to spray apply loose-fill insulation (e.g., fiberglass) without the use of an adhesive material that adheres or couples the loose-fill insulation. According to the embodiments, loose-fill fiberglass insulation is spray applied with water and particularly a water mist. It has been determined unexpectedly that when water is sprayed in fine droplets (i.e. mist) onto glass fibers at a certain glass/water ratio, loose-fill fiberglass insulation can be installed in cavities with a relatively uniform installed density, without excessive fly-off, and with reduced airborne dust during spray application. In one embodiment, the moisture content in the installed loose-fill insulation may range from about 2% to 20%. In another embodiment, the moisture content in the installed insulation may range from about 3% to 10%.

According to the embodiments, low moisture content is achieved, which reduces the drying time and facilitates the installation of other building materials, such as gypsum board, over the installed fiberglass insulation. While not wishing to be bound by any particular theory, it is believed that the capillary force created by the thin film of water on the surface of the glass fibers holds the fibers together against the turbulence generated by the air from the installation hose. Due to the low viscosity of water, very fine water droplets (i.e., mist) can be generated from spray tips, facilitating the fast formation of a thin water film on the glass fibers in the loose-fill insulation. The high surface energy of the glass fibers in the loose-fill insulation may facilitate the creation of a strong capillary force due to the affinity of water molecules to the glass fiber surfaces.

According to some embodiments, the glass fibers are micro-fibers, or fibers having a diameter of between about 0.5 μm and 5.0 μm. In other embodiments, the diameter of the glass fibers more commonly ranges from between about 0.5 μm and 3 μm. Due to the high surface area of fine or micro-glass fibers, the thin water film on the glass fibers creates significant capillary forces, which aids in holding fibers together against high velocity air during the spray application process.

In some embodiments, various additives may optionally be added to the water for various reasons. Suitable additives may include antifreeze agents, mold resistant agents, anti-corrosion agents, dyes, and the like. For example, anti-freeze agents, such as propylene glycol, can be added to the water to prevent freezing in colder climates. Alternatively, these additives can be added to the glass fibers during the manufacturing of the loose-fill fiberglass insulation product. Other additives can be added to the water or loose-fill fiberglass insulation to aid in the wetting of the glass fibers and water. For example, during production of loose-fill fiberglass insulation, various fluids may be applied to the fiberglass to control dust and static. Some of these fluids may impact the wettability and/or speed with which the glass fibers are wet by water. Additives, such as surfactants, can be added to the water or loose-fill fiberglass insulation to improve wetting and/or reduce the wetting time. Exemplary surfactants include Surfonic LF-37 manufactured by Huntsman Corp.

Once the loose-fill insulation is spray applied with water, the entanglement and the spring effect of fibers functions to hold the fiberglass in the cavities, even when the water is completely evaporated.

In some embodiments, the nodule size of loose-fill insulation may be between about ⅛" and ½", although larger nodule sizes may be used. The small nodule size may enable a uniform installed density with minimal voids, even when the cavity includes various obstacles, such as wiring, electric box, or the like.

An advantage of the loose-fill insulation embodiments is the non-stickiness of the installed loose-fill insulation. For loose-fill insulation that is spray applied, a powered rotary scrubbing device is typically used to remove the excess insulation from the area beyond the stud-defined cavity space. For loose-fill insulation that is spray applied with adhesives, the stickiness of the wet insulation often causes the scrubber to tear large chunks of insulation from the cavity, causing voids and uneven surfaces of the installed insulation. This issue is eliminated or greatly reduced when loose-fill insulation is spray applied with water as described herein.

The embodiments can be used for installing loose-fill insulation on or above any suitable surface such as, for example, a surface of a cavity such as a wall cavity, floor cavity, ceiling cavity, and/or attic cavity. The cavity may be comprised of sheathing and framing members and provide containment for the loose-fill insulation. The embodiments can be used for installing loose-fill insulation, or forming a loose-fill insulation product, for residential and/or commercial building structures. Having described the embodiments generally, additional features and aspects of the embodiments will be more evident with respect to the description of the drawings provided herein below.

Loose-Fill Insulation System Embodiments

Referring now to FIG. 1, an exemplary system 1 for installing loose-fill insulation within a cavity is provided. A hopper 2 is provided to receive an insulation material, such as a bag of the loose-fill insulation material. In some embodiments, a loose-fill forming component or shredder 3 may be attached to the hopper. The loose-fill forming component or shredder may include teeth, breaker pins, or other components that are configured to break or shred the compressed insulation material into a plurality of loose-fill insulation particles. The loose-fill insulation particles are then fed into an air lock 9, from which the insulation particles are blown by a blower component 4 into a hose 6.

The hose 6 can be from about 25 to about 600 feet, and more commonly about 50 to about 200 feet. The average inner diameter of the hose 6 can depend on the particular application and/or the size of insulation particles being conveyed, and can be at least about 2 inches, about 3 to about 6 inches, more commonly about 3.5 to about 4 inches. The hose 6 can have a substantially smooth inner surface and/or an inner surface having protrusions formed from corrugations, ribs or a spiraled structure. The hose 6 can have any suitable cross-sectional profile, for example, an elliptical, circular or polygonal cross-sectional profile.

The blowing component 4 suspends the insulation particles in air and blows the suspension through hose 6 and out a nozzle 5 that is positioned at the distal end of the hose 6. The hose 6 receives the flow of the suspension from the blower component 4 and conveys the flow proximate to the surface 12 to be insulated, such as a surface of a wall cavity. The suspension 8 can be directed at the surface 12 and ejected from the hose 6 via nozzle 5 connected to the end of the hose 6. In some embodiments, the suspension 8 may include glass fibers having a diameter between about 0.5 and 5 microns.

Water or a water mist is applied to the insulation particles of the suspension 8 by at least one spray tip (i.e., a water mist application component) arranged at or adjacent to the nozzle 5. The spray tip applies a water mist to the suspension 8 as the suspension is blown through nozzle 5 into cavity 12. Alternatively, the water mist can be applied to the insulation particles within the hopper 2, at the blower component 4, and/or within the hose 6. The water may be applied so that a moisture content of the installed loose-fill insulation particles is between about 2% and 20%. In other embodiments, the moisture content of the installed loose-fill insulation particles may be between about 3% and 10%. The water mist application component may apply the water mist under pressure between about 300 and 1500 lbs per square inch to the loose-fill insulation particles. As described herein, the water mist aids in retaining the suspension 8 (i.e., loose-fill insulation particles) within the cavity 12 without requiring the use of an enclosure member that encloses the cavity. The water mist also enables the suspension 8 to be applied within the cavity without requiring the use of an adhesive, such as a water soluble adhesive material, as used in conventional processes. As such, the installed loose-fill insulation particles are substantially and/or entirely free of an adhesive material that adheres the insulation particles together within the cavity. As shown in FIG. 1, the water can be supplied from a source 20 (e.g., tote, barrel, bucket, water-supply hose, and the like) using a pressure line 7 and a pump 22. Exemplary pumps 22 are available from Wanner International Ltd. under the trademark Hydra-Cell or from Graco Inc. under the trademark Magnum X5. Exemplary insulation blowing machines include, but are not limited to, Volu-Matic® III blowing machine from Unisul (Winter Haven, Fla.), Model 125 blowing machine from Capital Machine (Montgomery, Ala.), and Model 1500 blowing machine from Meyer (Libertyville, Ill.).

Figure 2A:
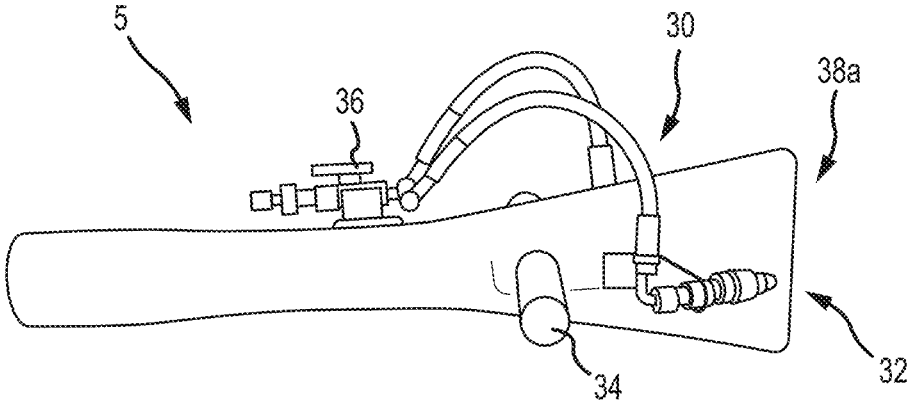
FIGS. 2*a-b* illustrate water mist application components according to an embodiment.
Figure 2B:
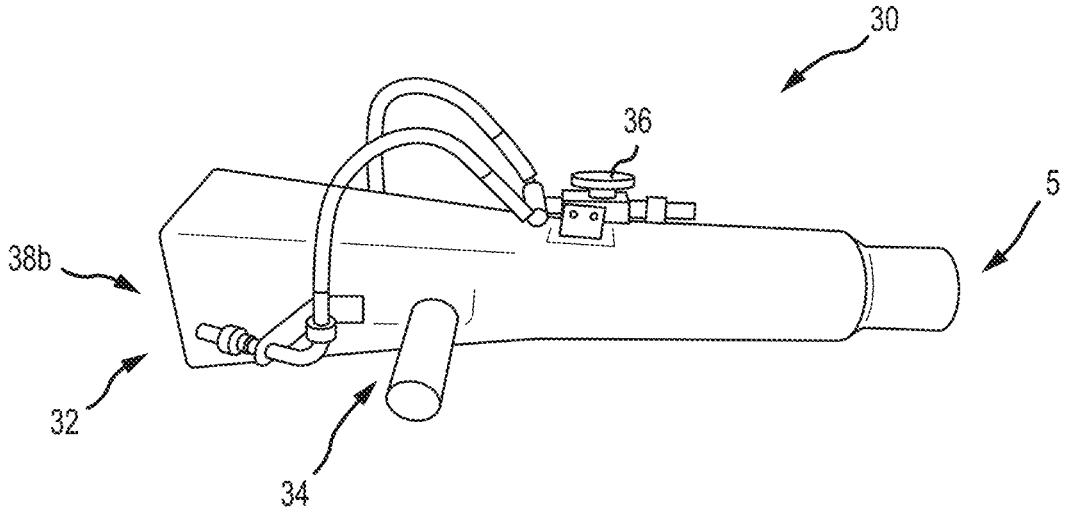

Referring now to FIGS. 2*a-b*, illustrated are embodiments of a water mist application components 30 (hereinafter component 30). Specifically, FIG. 2*a* illustrates a high density nozzle (HDN) while FIG. 2*b* illustrates a low density nozzle (LDN). Both nozzles will be generally referred to as component 30. In addition, many of the components of the high density and low density nozzles are similar in design and/or function, and therefore, the similar components will be referred to in FIGS. 2*a-b* using the same number.

The component 30 may be attached to the distal end of the nozzle 5 of system 1. The component 30 includes an exit port 38*a-b* and lumen through which the suspension of loose-fill insulation particles travel during the installation process. The component 30 also includes one or more handles 34 that can be arranged at or near the nozzle 5 to assist an operator in directing the flow of the loose-fill insulation particles at the surface to be insulated. One or more jet spray tips 32, and preferably two or more jet spray tips 32 can be arranged for applying the water or water mist to the insulation particles. The jet spray tips 32 and the pumping system may be configured to provide a water flow rate of between at least 0.5 and 4.0 lbs/min. An exemplary jet spray tip 32 is the UniJet® spray tip manufactured by Spraying Systems Co. The water or water mist can be applied onto the insulation particles during or after such particles are ejected from the port 38*a-b* of component 30.

In the high density nozzle (HDN), the exit port or opening 38*a* is restricted, which accelerates the discharge of the insulation particles. In some embodiments, the exit port or opening 38*a* of the HDN nozzle may be tapered to boost the velocity of the loose-fill insulation particles and thereby achieve a higher installed density. In the low density nozzle (LDN), the exit port or opening 38*b* is expanded, which reduces the velocity of the discharge of the insulation particles. The expanded LDN nozzle exit port 38*b* may be used to reduce the velocity of loose-fill insulation particles to achieve a lower installed density.

As described herein, the water or water mist can increase the adherence of the insulation particles to each other and/or the surface to be insulated, and can result in the formation of a stable insulation product without requiring the use of an adhesive to bind or adhere the insulation particles. While not wishing to be bound by any particular theory, it is believed that the capillary force created by the water sprayed onto the suspension of loose-fill insulation particles holds the fibers together against the turbulence generated by the air from the installation hose and nozzle 5. Due to the low viscosity of water, very fine water droplets (i.e., mist) can be generated from spray tips, facilitating the fast formation of a thin water film on the glass fibers in the loose-fill insulation. The high surface energy of the glass fibers in the loose-fill insulation may facilitate the creation of a strong capillary force due to the affinity of water molecules to the glass fiber surfaces.

Conventional spray-applied loose-fill insulation systems use adhesive materials (commonly aqueous adhesive) to bind or adhere the loose-fill insulation particles. The adhesive materials are typically sprayed through jet spray tips. The aqueous adhesive are commonly made up by adding the proper amount of water to a tank and then adding the proper amount of a resin, preferably a concentrated solution of the resin, to the water in the tank while optionally stirring to insure proper mixing. In some embodiments, a powdered resin may be used, although more time and stirring may be required to obtain the solution.

A pump that is connected to the tank supplies the aqueous adhesive at the desired rate and pressure to the spray jet(s) through one or more flexible hoses in order to coat the loose-fill insulation particles with the desired amount of aqueous adhesive. The adhesive materials used in conventional processes commonly have high viscosities, commonly in the range of about 200 centipoises at room temperature. As such, the pump that supplies the aqueous adhesive to the spray jets needs to be relatively high powered. Further, the viscosity of the adhesive material typically increases exponentially with lower temperatures. For example, the adhesive materials commonly have a viscosity of over 1,000 centipoises at temperatures close to freezing. As such, when the aqueous adhesive is in the tank and/or as the aqueous adhesive is being sprayed, it is generally required to heat the aqueous adhesive and to maintain the heat of the adhesive throughout the installation process. As such, the pump that supplies the aqueous adhesive is typically insulated in addition to being high powered to provide a sufficient atomization of the spray adhesive particles. Such pumps are commonly expensive.

In contrast, water exhibits a viscosity of about 1 centipoise at room temperature and this number does not fluctuate significantly with decreasing temperatures. For example, the viscosity of water is 1.52 centipoises at the temperature of 5° C. Accordingly, lower powered and less expensive pumps may be used with the embodiments described herein and finer water mists, or finer atomization of the water particles, may be achieved with the embodiments described herein. The finer water mist may aid in forming the thin film of water that facilitates in holding the loose-fill insulation together during installation.

In some embodiments, an additive may be added to the water and/or to the loose-fill insulation particles. The additive may enhance a property or characteristic of the installed insulation. For example, in some embodiments an anti-mold agent, such as chlorine, may be added to the water and/or loose-fill insulation. The anti-mold agent may prevent or hinder the formation of mold on the sheathing or framing materials that define or form the cavity. In other embodiments, an antifreeze agent, anti-corrosion agent, dye, and the like may be added to the loose-fill insulation particles and/or water.

In a specific embodiment, a surfactant may be added to the water to enhance the wettability of the loose-fill insulation particles by water. For example, in some instances a silicone material may be applied to the insulation material to enhance the water resistance of the insulation for various reasons. In such instances, the silicone may function to repel the water that is applied during installation, thereby significantly decreasing the wettability of the glass fibers. In such instances, a surfactant may be added to the water to enhance the wettability of the fibers and thereby provide the loose-fill insulation application benefits described herein. Specifically, the addition of the surfactant allows the insulation to be installed without requiring an enclosure member or the use of an adhesive material—either a powdered or aqueous adhesive. As such, the installed insulation product may be substantially or entirely free of an adhesive even when silicone is applied to the loose-fill insulation fibers.

As shown in FIGS. 2*a-b*, in some embodiments the component 30 includes two jet spray tips 32 that are positioned on opposite sides of the component 30. The two jet spray tips 32 simultaneously spray water mist onto opposite sides of the loose-fill insulation particles as the particles exit the nozzle. The simultaneous coating of water mist onto both sides of the loose-fill insulation particles may result in a more uniform coating of the water mist on the loose-fill insulation particles, which may aid in holding the particles together within the wall cavity. In other embodiments, however, component 30 may include a single jet spray tip 32 or three or more jet spray tips 32 as desired.

Figure 3:
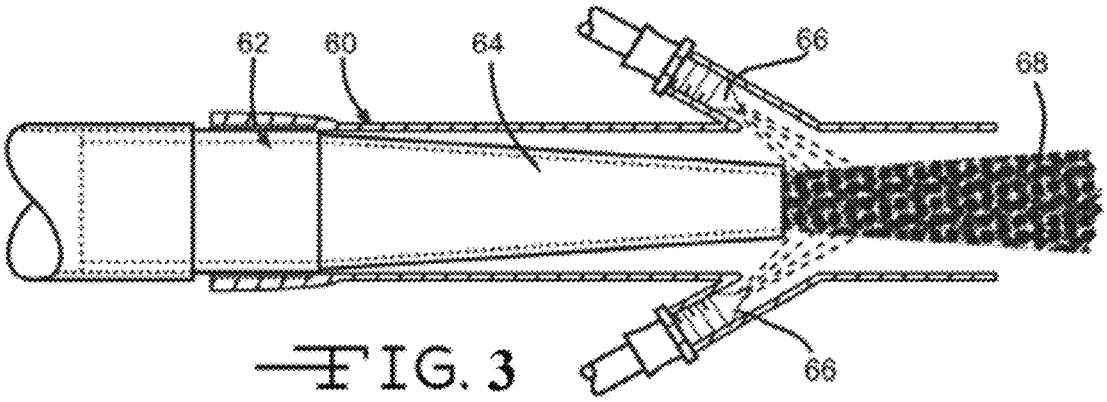
FIG. 3 illustrates another water mist application component according to an embodiment.

Referring now to FIG. 3, illustrated in another embodiment of a water mist application component 60 (hereinafter component 60). Component 60 is coupled with a distal end of nozzle 62. In some embodiments, the nozzle 62 may include a tapered or accelerator section 64 that boosts the velocity of the loose-fill insulation particles 68 that are blown from the nozzle 62. Component 60 also includes one or more spray jets 66 that are mounted to a body of component 60 so that a distal end of the jets 66 are positioned within the body of component 60. As described herein, the jets 66 spray water or a water mist into the stream of the loose-fill insulation particles 68 as the particles exit the nozzle 62. As shown in FIG. 3, component 60 may include multiple jets 66 that are positioned on opposite sides of the component 60 and loose-fill insulation particles 68. In other embodiments, a single jet 66 may be used.

Loose-Fill Insulation Methods

Figure 4:
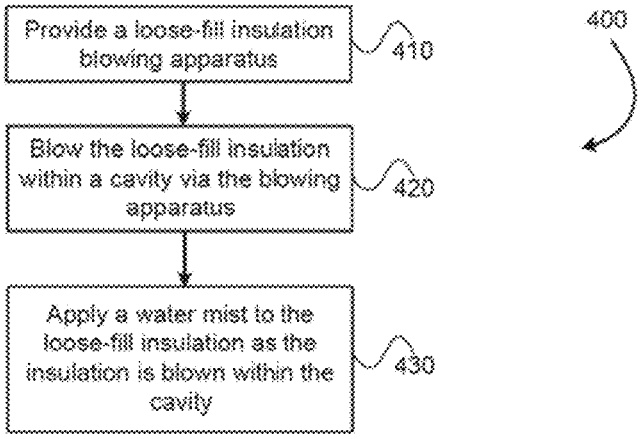
FIG. 4 illustrates a method of applying loose-fill insulation within a cavity according to an embodiment.

Referring now to FIG. 4, illustrated is a method 400 of applying loose-fill insulation within a cavity. At block 410, a loose-fill insulation blowing apparatus is provided. As described herein, the loose-fill insulation blowing apparatus/machine includes a hopper, a shredder compartment, an air lock, air blower, a hose that is attached to the outlet of the blowing machine; and a nozzle that is attached to a distal end of the hose. The loose-fill insulation particles are blown through the hose and nozzle via the blower during application of the loose-fill insulation material within the cavity.

At block 420, the loose-fill insulation particles are blown through the nozzle into the cavity via the blower and at block 430, a water mist is applied to the loose-fill insulation particles as the insulation particles are blown through the nozzle into the cavity. The water mist is applied to the loose-fill insulation particles so that a moisture content of the installed loose-fill insulation is between about 2% and 20%. In other embodiments, the water mist is applied to the loose-fill insulation particles so that the moisture content of the installed loose-fill insulation is between about 3% and 10%. The water mist aids in retaining the loose-fill insulation particles within the cavity without requiring the use of an enclosure member that encloses the cavity and without requiring the use of an adhesive material, such as the aqueous adhesives described above. As such, the loose-fill insulation material is substantially or entirely free of an adhesive material that adheres the loose-fill insulation particles together within the cavity.

In some embodiments, the loose-fill insulation includes fiberglass and the glass fibers have a diameter between about 0.5 and 5 microns. As described herein, these finer glass fibers may increase the capillary effects of the water film, such as by increasing the surface area of glass fibers, which may aid in holding the loose-fill fiberglass insulation particles together within the cavity. In some embodiments, the water mist may be applied to the loose-fill fiberglass insulation particles under pressure between about 300 and 1500 lbs per square inch. In some embodiments, the water mist may be applied to the loose-fill fiberglass insulation particles by spraying the water mist onto a first side of the loose-fill fiberglass insulation particles via a first spray tip and by simultaneously spraying the water mist onto a second side of the loose-fill fiberglass insulation particles via a second spray tip. The second side may be opposite the first side.

In some embodiments, the loose-fill fiberglass insulation particles or the water mist may include one or more additives. Suitable additives may include antifreeze agents (e.g., propylene glycol), mold resistant agents (e.g., chlorine agents), anti-corrosion agent (e.g., triethanolamine), dyes (e.g., blue dye), and the like. In a specific embodiment, the additive may include a surfactant, such as Surfonic LF-37. The surfactant may be added to increase the wettability of the fiberglass insulation. The surfactant may allow the water mist to properly coat glass fibers that are coated with a material, such as silicone.

Figure 5:
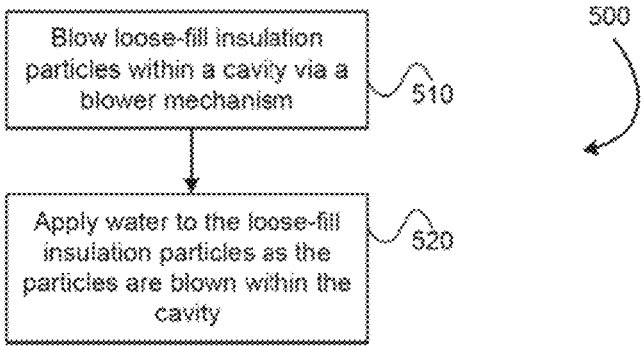
FIG. 5 illustrates another method of applying loose-fill insulation within a cavity according to an embodiment.

Referring now to FIG. 5, illustrated is another method 500 of applying loose-fill insulation within a cavity. At block 510, loose-fill insulation particles are blown into a cavity of a structure to install the loose-fill insulation within the cavity and thereby insulate the structure. The loose-fill insulation particles are blown, via a blower mechanism, through a hose and a nozzle attached to a distal end of the hose to install the loose-fill insulation within the cavity. At block 520, water is applied to the loose-fill insulation particles so that a moisture content of the installed loose-fill insulation is between about 2% and 20%. As described herein, the water aids in retaining the loose-fill insulation particles within the cavity without requiring the use of an enclosure member that encloses the cavity. Unlike conventional methods, the loose-fill insulation is substantially or entirely free of a water soluble or powder adhesive material that adheres the loose-fill insulation particles together within the cavity.

In some embodiments, the moisture content of the installed loose-fill insulation is between about 3% and 10%. In some embodiments, the loose-fill insulation particles comprise glass fibers and the glass fibers have a diameter between about 0.5 and 5 microns. In some embodiments, the water mist is applied to the loose-fill insulation particles under pressure between about 300 and 1500 lbs per square inch. In some embodiments, the water mist is applied to the loose-fill insulation particles by spraying the water mist onto a first side of the loose-fill insulation particles via a first spray tip and by simultaneously spraying the water mist onto a second side of the loose-fill insulation particles via a second spray tip, the second side being opposite the first side. In some embodiments, the loose-fill insulation particles and/or water include one or more additives, which may include: antifreeze agents, mold resistant agents, anti-corrosion agent, dyes, and/or surfactants.

Examples

Several tests were conducted to determine the effectiveness of installing loose-fill insulation within cavities in accordance with the embodiments described herein. In a first test, fiberglass insulation was blown into a cavity that was approximately 14.5 inches wide, 3.5 inches deep, and 93 inches tall. The fiberglass insulation was blown into the cavity using either a Wanner Hydra-Cell Model D03X pump or a Graco Magnum X5 pump. A high density (HDN) or low density (LDN) nozzle was coupled at a distal end of a hose through which the fiberglass insulation was blown. A high density nozzle (HDN) has a restricted exit opening which accelerates the discharge of the insulation particles; while a low density nozzle (LDN) has an expanded exit opening which reduces the velocity of the discharge of the insulation particles. Two UniJet 650025 spray tips were positioned on opposite sides of a distal end of the nozzle and used to spray a water mist onto the fiberglass insulation as the insulation was blown into the cavity. An adhesive material, either aqueous or powdered, was not applied to the fiberglass insulation during or subsequent to installation of the fiberglass insulation within the cavity. As such, the installed fiberglass insulation was free of an adhesive material. The cavity was not enclosed (i.e., did not include an enclosure member), or stated differently, the cavity included an open surface or face within which the fiberglass insulation was blown. The results of the first test are shown in table of FIG. 6.

As shown in FIG. 6, a water flow rate of greater than 1.00 lbs/min was used for each test, and in six of the nine tests, a water flow rate of about 2.00 lbs/min or greater was used. In three tests, the water flow rate was greater than 3.00 lbs/min. The moisture content of the installed insulation was less than 10% in each of the tests and commonly between about 4 and 7%. The increased water flow rate typically corresponded to an increase in the moisture content of the installed insulation. The installed density of the wet fiberglass insulation was between 1.10 and 2.00 pcf (lbs/ft$^3$) and more commonly between about 1.50 and 2.00 pcf. When the fiberglass insulation dried, the installed density decreased slightly to about 1.00 and 1.80 pcf and more commonly between about 1.40 and 1.70 pcf. The installed insulation was able to dry relatively quickly.

In a second test, fiberglass insulation was blown into a cavity that was approximately 22.5 inches wide, 5.375 inches deep, and 92.5 inches tall. The fiberglass insulation was blown into the cavity using a Graco Magnum X5 pump. A high density (HDN) or low density (LDN) nozzle was coupled at a distal end of a hose through which the fiberglass insulation was blown. Two UniJet 650025 spray tips were positioned on opposite sides of a distal end of the nozzle and used to spray a water mist onto the fiberglass insulation as the insulation was blown into the cavity. An adhesive material, either aqueous or powdered, was not applied to the fiberglass insulation during or subsequent to installation of the fiberglass insulation within the cavity. As such, the installed fiberglass insulation was free of an adhesive material. The cavity was not enclosed (i.e., did not include an enclosure member), or stated differently, the cavity included an open surface or face within which the fiberglass insulation was blown. The results of the second test are shown in the table of FIG. 7.

As shown in FIG. 7, a water flow rate of greater than 3.00 lbs/min was used for each test. The moisture content of the installed insulation was between about 9 and 11%. The installed density of the wet fiberglass insulation was between 1.70 and 1.90 pcf (lbs/ft$^3$) for the test conducted with the high density nozzle and between 1.15 and 1.20 pcf for the test conducted with the low density nozzle. When the fiberglass insulation dried, the installed density decreased slightly to about 1.50 and 1.70 pcf for the test conducted with the high density nozzle and between 1.05 and 1.10 pcf for the test conducted with the low density nozzle. The installed insulation was able to dry relatively quickly.

In a third test, fiberglass insulation was blown into an overhead cavity that was approximately 23.25 inches wide, 18 inches deep, and 95.75 inches long. The fiberglass insulation was blown into the cavity using a Graco Magnum X5 pump. A high density (HDN) nozzle was coupled at a distal end of a hose through which the fiberglass insulation was blown. Two UniJet 650025 spray tips were positioned on opposite sides of a distal end of the nozzle and used to spray a water mist onto the fiberglass insulation as the insulation was blown into the cavity. An adhesive material, either aqueous or powdered, was not applied to the fiberglass insulation during or subsequent to installation of the fiberglass insulation within the cavity. As such, the installed fiberglass insulation was free of an adhesive material. The overhead cavity was not enclosed (i.e., did not include an enclosure member), or stated differently, the overhead cavity included an open surface or face through which the fiberglass insulation was blown. The results of the third test are shown in the table of FIG. 8.

As shown in FIG. 8, a water flow rate of greater than 3.00 lbs/min and a high density (HDN) nozzle was used for the test. The installed density of the dry fiberglass insulation was between 2.20 and 2.30 pcf (lbs/ft$^3$). The installed insulation was able to dry relatively quickly and remained within the overhead cavity subsequent to installation.

Additional tests were conducted to determine the effects of adding a surfactant to water to aid in the wetting of the loose-fill insulation material. Specifically, three loose-fill fiberglass insulation products, which contain no silicone (Product 1), a medium level of silicone (Product 2, containing~0.04% silicone), and a high level of silicone (Product 3, containing~0.08% silicone), were tested to determine their wettability by water.

To develop the test specimens, 14.84 grams of loose-fill insulation was packed into a 12-inch long clear polycarbonate tube of 1-inch inner diameter in order to achieve a test density of 6.0 lbs/ft$^3$. During the filling process, care was taken to obtain a uniform filling of loose-fill insulation inside the tube with no gaps.

In performing the tests, 150 grams of water was added into a beaker. A stiff metal screen was placed inside the beaker and submerged in water. The beaker was then placed on a balance, which was tared before the start of the testing. To start the wettability testing, a cylinder filled with loose-fill insulation was placed vertically on the metal screen inside the beaker. The cylinder was lifted above the surface of water at every 30-second interval; and the mass of water absorbed by loose-fill insulation inside the tube was measured by the balance. The masses of water absorbed at different time intervals were recorded, until the total time of absorption reached 10 minutes. In the cases where surfactant was used, certain amount of surfactant was pre-mixed with water to obtain the desired surfactant concentration, and the surfactant solution was then added into beaker for the wettability test.

Figure 9:
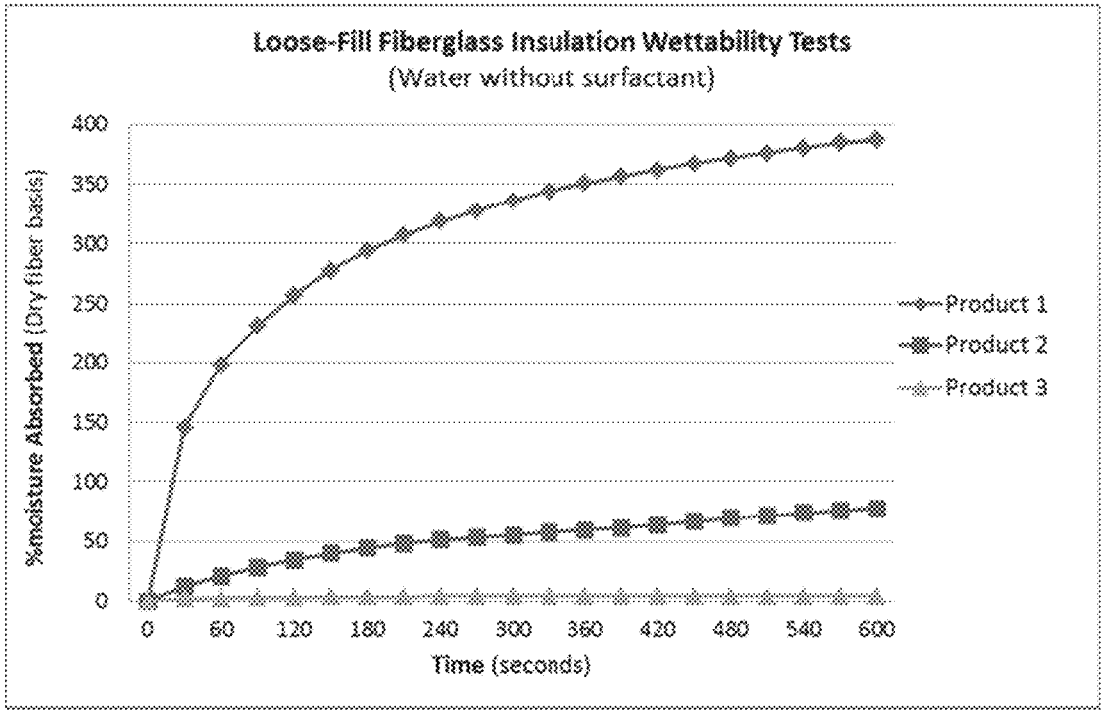
FIGS. 9-10 illustrates graphs of data resulting from the tests conducted to determine the effects of adding a surfactant to water in wetting the loose-fill insulation material in accordance with the embodiments described herein.

Calculations were performed to determine the weight percent of moisture gain on the basis of dry fiber at different time intervals. The results of the wettability tests are provided in FIGS. 9 and 10. FIG. 9 shows the impact of water repelling silicone on the wettability of loose-fill fibers by water. Product 1, which contained no silicone, showed the highest wettability by water. On the other hand, Product 3, which contained the highest level of silicone among the three products tested, showed minimal wetting by water. Product 2, which contained silicone but at a level less than Product 3, exhibited characteristic similar to Product 3 in that wetting was far less than Product 1.

Figure 10:
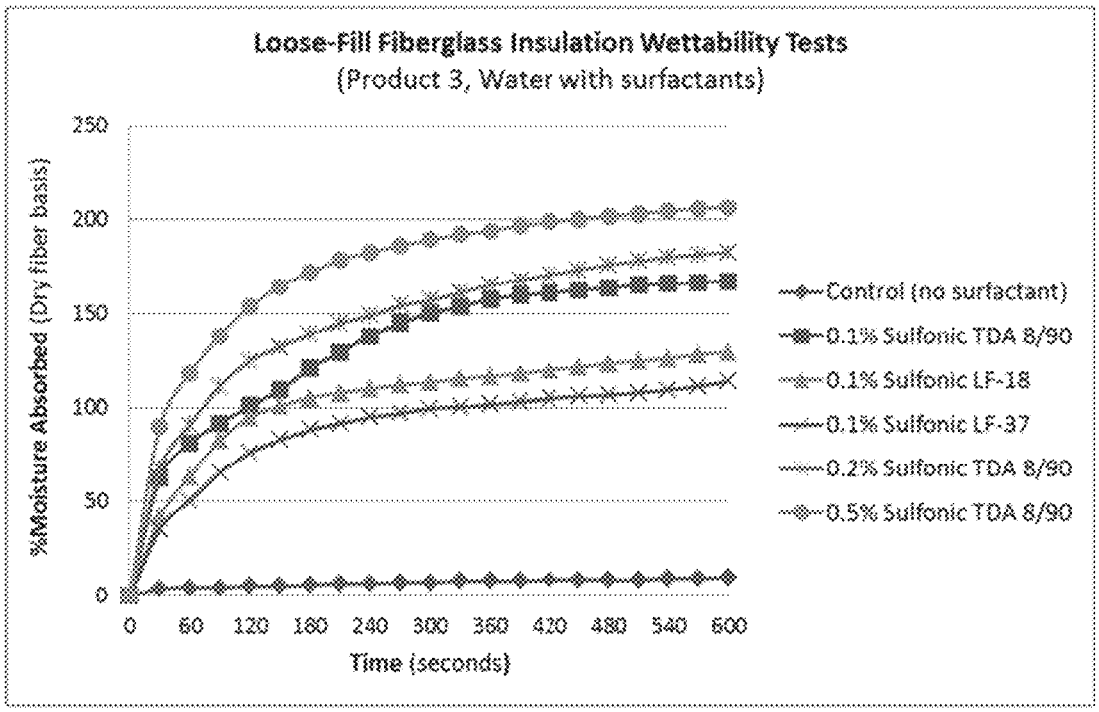

FIG. 10 shows the impact of surfactant on the wettability of loose-fill fibers. Product 3 was chosen for the testing, since it contained the highest level of silicone. Without any surfactant (i.e., the control), there was minimal wetting of Product 3 by water. Three surfactants were tested, including Surfonic TDA 8/90, Surfonic LF-18, and Surfonic LF-37, all of which are manufactured by Huntsman Corp. When a very low level of surfactants was added to water (0.1% by weight), a significant increase in wettability was observed for all three surfactants tested. Increasing the level or concentration of the surfactant, such as Surfonic TDA 8/90, further increased the wettability of the fibers of Product 3 as shown in FIG. 10.

Figures 11, 12:
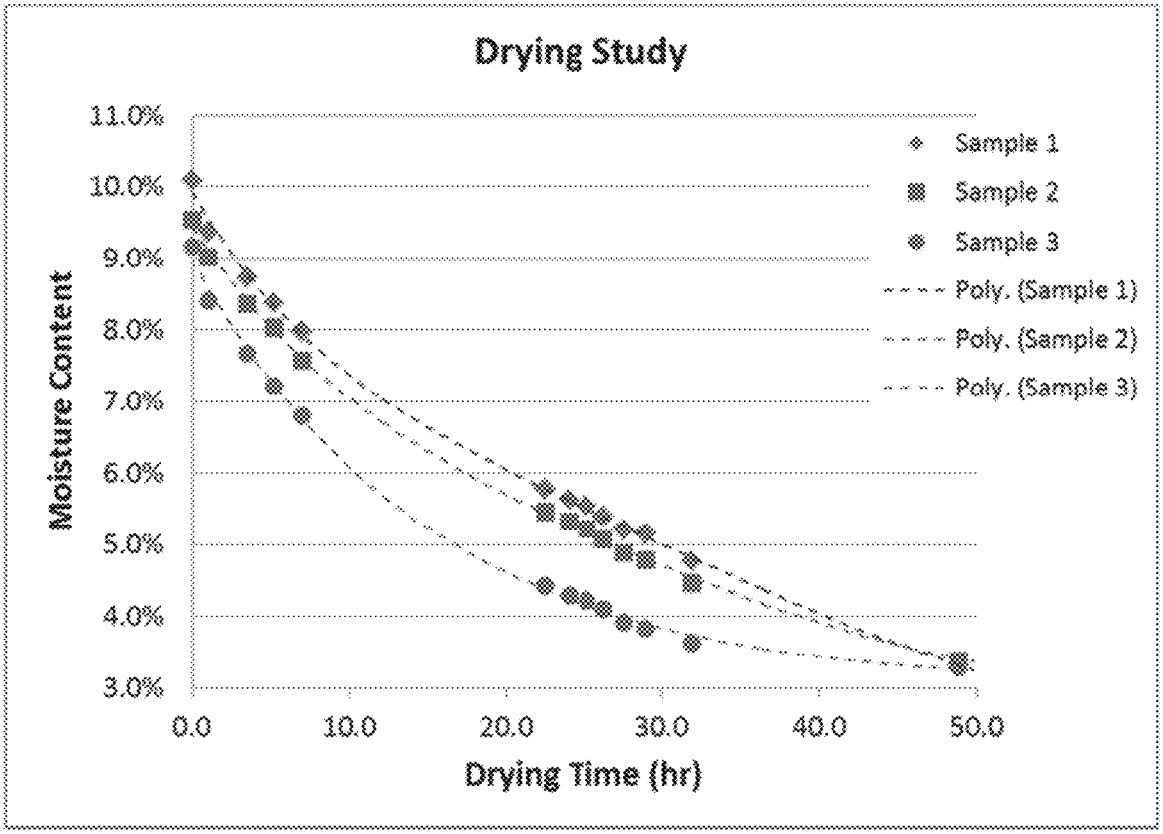
FIG. 11 illustrates a table of data resulting from tests conducted to determine the drying rate of installed loose-fill fiberglass insulations applied with water in accordance with the embodiments described herein.
FIG. 12 illustrates a graph of data resulting from tests conducted to determine the rate of moisture loss of samples subjected to a controlled environment in accordance with the embodiments described herein.

Additional tests were conducted to determine the drying rate of the installed loose-fill fiberglass insulations spray applied with water. Specifically, in preparing test specimens, three frames with the cavity size of approximately 21.5"×21.5"×5.5" were built with 2×6 wood studs. One side of each frame was covered with oriented strand board (OSB) while the other side was left open for the spray application of loose-fill fiberglass insulation. The three frames were filled with loose-fill fiberglass insulation spray applied with water in accordance with the embodiments described herein. Adjustments in spray distance were made to obtain different installed densities. Data of the three frames is shown in FIG. 11 including: the water flow rate, the blowing nozzle type, the installed density (wet and dry), and the moisture content. A Graco Magnum X5 pump was used for the test.

The frames were placed into a conditioning room for the drying study. The temperature and relative humidity of the conditioning room was approximately 70° F. and 50%, respectively. The open side of each frame was left uncovered during the drying study in order to mimic field application conditions. The moisture loss was measured at different drying times. At the end of the drying test, the samples were completely dried in an oven to determine the dry mass of the insulation, which was used for the residual moisture content calculation.

FIG. 12 illustrates the rate of moisture loss of each sample subjected to the controlled environment (i.e., temperature of 70° F. and relative humidity of 50%). FIG. 12 demonstrates that all three samples exhibited fast drying. For example, under the relatively humid environment, greater than 20% of the total moisture was evaporated within approximately the first 7 hours and roughly ½ of the moisture was evaporated after 24 hours. The residual moisture content of samples 1, 2, and 3 was approximately 5.6%, 5.3%, and 4.3%, respectively.

Compared with conventional spray applied loose-fill insulation systems, such as cellulose, the low initial moisture content and the fast drying of the system described herein facilitates the installation of other building materials, such as gypsum board, over the installed loose-fill fiberglass insulation.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A method of applying loose-fill insulation within a cavity comprising:

breaking compressed loose-fill insulation material into a plurality of loose-fill insulation nodules, wherein a nodule size of each the plurality of loose-fill insulation nodules is between about 0.125 inches and 0.5 inches;

blowing the loose-fill insulation nodules to deliver the loose-fill insulation nodules into a cavity of a structure; and applying a water mist to the loose-fill insulation nodules as the insulation nodules are blown into the cavity to form installed loose-fill insulation having a moisture content of between about 2% and 20%, wherein the installed loose-fill insulation is free of an aqueous or powdered adhesive material that adheres the loose-fill insulation nodules together within the cavity such that the installed loose-fill insulation is free of an adhesive material.

2. The method of applying loose-fill insulation within a cavity of claim 1, wherein:

the loose-fill insulation material comprise fibers having diameters of between about 0.5 μm and 5.0 μm.

3. The method of applying loose-fill insulation within a cavity of claim 1, wherein:

the water mist comprises one or more additives.

4. The method of applying loose-fill insulation within a cavity of claim 3, wherein:

the one or more additives comprise one or more of an antifreeze agent, a mold-resistant agent, an anti-corrosion agent, a dye, and a wettability agent.

5. The method of applying loose-fill insulation within a cavity of claim 4, wherein:

the wettability agent comprises a silicone material.

6. The method of applying loose-fill insulation within a cavity of claim 1, further comprising:

removing excess insulation from an area beyond the cavity using a rotary scrubbing device.

7. The method of applying loose-fill insulation within a cavity of claim 1, wherein:

applying the water mist comprises simultaneously spraying the water mist onto opposite sides of the loose-fill insulation nodules using at least two spray tips that are positioned on opposing sides of a water mist applicator device.

8. A method of applying loose-fill insulation within a cavity comprising:

breaking compressed loose-fill insulation material into a plurality of loose-fill insulation nodules;

blowing the loose-fill insulation nodules into a cavity of a structure; and applying a water mist to the loose-fill insulation nodules as the insulation nodules are blown into the cavity to form installed loose-fill insulation having a moisture content of between about 2% and 20%, wherein the installed loose-fill insulation is free of an aqueous or powdered adhesive material that adheres the loose-fill insulation nodules together within the cavity such that the installed loose-fill insulation is free of an adhesive material.

9. The method of applying loose-fill insulation within a cavity of claim 8, wherein:

the loose-fill insulation material comprise one or more of slag wool, mineral wool, rock wool, ceramic fiber, carbon fiber, composite fibers, and glass fibers.

10. The method of applying loose-fill insulation within a cavity of claim 8, wherein:

breaking the compressed loose-fill insulation material comprises shredding the compressed loose-fill insulation material to form the plurality of loose-fill insulation nodules using a shredder of a loose-fill insulation application device.

11. The method of applying loose-fill insulation within a cavity of claim 8, wherein:

the water mist is applied at a pressure of between about 300 lbs per square inch and 1500 lbs per square inch.

12. The method of applying loose-fill insulation within a cavity of claim 8, wherein:

the water mist is applied at a flow rate of between 0.5 lbs/min and 4.0 lbs/min.

13. The method of applying loose-fill insulation within a cavity of claim 8, wherein:

the water mist aids in retaining the loose-fill insulation nodules within the cavity without requiring the use of an enclosure member that encloses the cavity.

14. The method of applying loose-fill insulation within a cavity of claim 8, wherein:

the water mist is applied using one or more jet spray tips.

15. A method of applying loose-fill insulation within a cavity comprising:

distributing loose-fill insulation nodules into a cavity of a structure; and applying a water mist to the loose-fill insulation nodules as the insulation nodules are blown into the cavity to form installed loose-fill insulation having a moisture content of between about 2% and 20%, wherein the installed loose-fill insulation is free of an aqueous or powdered adhesive material that adheres the loose-fill insulation nodules together within the cavity such that the installed loose-fill insulation is free of an adhesive material.

16. The method of applying loose-fill insulation within a cavity of claim 15, wherein:

the installed loose-fill insulation is applied at a density of between 1.10 pcf and 2.0 pcf when wet.

17. The method of applying loose-fill insulation within a cavity of claim 15, wherein:

the installed loose-fill insulation has a density of between 1.00 pcf and 1.8 pcf when dry.

18. The method of applying loose-fill insulation within a cavity of claim 15, wherein:

the loose-fill insulation nodules are distributed into the cavity using an insulation blowing machine.

19. The method of applying loose-fill insulation within a cavity of claim 18, wherein:

the insulation blowing machine comprises a blowing component that delivers the loose-fill insulation nodules to the cavity via a hose.

20. The method of applying loose-fill insulation within a cavity of claim 19, wherein:

the blowing component suspends the loose-fill insulation nodules in air and blow the suspended loose-fill insulation nodules through the hose and out a nozzle.

* * * * *